US009365312B2

(12) United States Patent
Tritz

(10) Patent No.: US 9,365,312 B2
(45) Date of Patent: Jun. 14, 2016

(54) TAMPER EVIDENT SEAL

(71) Applicant: JT International SA, Geneva (CH)

(72) Inventor: Franz-Josef Tritz, Palzem (DE)

(73) Assignee: JT INTERNATIONAL SA, Geneva (CH)

( * ) Notice: Subject to any disclaimer, the term of this patent is extended or adjusted under 35 U.S.C. 154(b) by 0 days.

(21) Appl. No.: 14/407,827

(22) PCT Filed: Jul. 17, 2013

(86) PCT No.: PCT/EP2013/065045

§ 371 (c)(1),
(2) Date: Dec. 12, 2014

(87) PCT Pub. No.: WO2014/012956

PCT Pub. Date: Jan. 23, 2014

(65) Prior Publication Data

US 2015/0166214 A1 Jun. 18, 2015

(30) Foreign Application Priority Data

Jul. 18, 2012 (EP) ..... 12176846

(51) Int. Cl.

| | |
|---|---|
| ***B65D 5/54*** | (2006.01) |
| ***B65D 5/42*** | (2006.01) |
| ***B65D 85/10*** | (2006.01) |
| ***B65B 19/16*** | (2006.01) |

(52) U.S. Cl.

CPC ..... *B65D 5/5415* (2013.01); *B65B 19/16* (2013.01); *B65D 5/4233* (2013.01);
(Continued)

(58) Field of Classification Search

CPC ..... B65D 5/54; B65D 5/5405; B65D 5/5415; B65D 5/4233; B65D 85/1009; B65D 85/1036; B65D 85/1063; B65B 19/16; B65B 19/14; A24F 15/16; A24F 15/12

USPC ..... 220/23.88, 23.87, 266, 265, 260; 206/236, 261, 807, 263, 268, 265, 747, 206/746, 745, 748, 749, 750; 229/103, 102, 229/121, 125.41, 125.39, 125.37, 120.03, 229/123.2, 123.3

See application file for complete search history.

(56) References Cited

U.S. PATENT DOCUMENTS 1,877,468 A * 9/1932 Enfant ..... B65D 7/02 206/256
1,965,133 A * 7/1934 Bambino ..... B65D 85/1027 206/264

(Continued)

FOREIGN PATENT DOCUMENTS

DE 20107274 U1 9/2001
EP 1964783 A2 9/2008

(Continued)

OTHER PUBLICATIONS

European Search Report issued on Oct. 16, 2013, that issued in the corresponding European Patent Application No. PCT/EP2013/065045.

*Primary Examiner* — Robert J Hicks

(74) *Attorney, Agent, or Firm* — Cowan, Liebowitz & Latman, P.C.; Steven D. Underwood

(57) ABSTRACT

Packaging (1) is provided with a frangible seal (180), together with a method of producing such packaging. The packaging comprises an outer packet part (100) and multiple inner packet parts (150) disposed within the outer packet part. The inner packet parts can move relative to the outer packet part between a closed position and an open position. The seal (180) comprises a body portion coupled to the outer packet part, and separable portions each coupled to one of the inner packet parts. When an inner packet part (150) is moved from the closed position to the open position, this causes the seal (180) to break.

15 Claims, 6 Drawing Sheets

(52) U.S. Cl.
CPC ..... *B65D 85/1009* (2013.01); *B65D 85/1036* (2013.01); *B65D 85/1063* (2013.01); *B65D 2101/0007* (2013.01); *B65D 2203/02* (2013.01)

(56) References Cited

U.S. PATENT DOCUMENTS 3,052,398 A * 9/1962 Benjamin ..... B65D 5/721 206/268
3,881,599 A * 5/1975 Flaherty ..... B65D 85/1036 206/268

FOREIGN PATENT DOCUMENTS

EP 2017198 A1 1/2009
GB 1250793 A * 10/1971 ..... B65D 5/721
GB 1394740 A * 5/1975 ..... B65D 85/1036

* cited by examiner

TAMPER EVIDENT SEAL

CROSS REFERENCE TO RELATED APPLICATIONS

This is a U.S. national stage of application No. PCT/EP2013/0654045, filed on Jul. 17, 2013 and European Application No. 12176846.9, filed Jul. 18, 2012, the entire disclosures of which are hereby incorporated by reference.

FIELD OF THE INVENTION

The present invention relates to the provision of seals for packaging. In particular, but not exclusively, the present invention relates to the provision of frangible seals which act as tax or revenue stamps on packaging for tobacco products such as cigarettes.

BACKGROUND TO THE INVENTION

It is a requirement in many countries that packaging for products to which a tax or duty is applied is sealed using a tamper evident tax or revenue seal. The purpose of the seal is to guarantee that the appropriate duty has been paid for each package containing such products. A particular example of such a practice is in packaging for cigarettes.

Typical cigarette packaging comprises a hinged lid coupled to a main body in which the cigarettes are held. To access the cigarettes, a consumer opens the hinged lid. A tax stamp of revenue seal may therefore be applied across the joint between the body of the packaging and the hinged lid, so that when the lid is opened, the seal is broken.

While this approach is suitable for conventional packaging, it is not always readily transferred to more innovative packaging forms. A particular concern arises with packaging in which the cigarettes are held in multiple compartments. In this case, it is essential that the seal is broken whichever of the compartments is accessed by the user. This is a particular challenge given that it is conventionally a requirement to use only a single seal on each item of packaging.

Appropriate solutions to this problem may be limited by restraints placed on the packaging. As well as design constraints, these may include legal constraints such as a requirement to display certain information on the packaging in certain locations, such as health warnings.

There is also a desire to implement a seal which avoids complexity in either design or application to the packaging, since this can increase the overall cost of the packaging.

There is, therefore, a desire to create a tamper evident seal which can be used on more complex packaging for cigarettes than conventional hinged lid packages. Simultaneously, constraints regarding cost, position, and the nature of the seal should be complied with.

SUMMARY OF THE INVENTION

According to a first aspect of the present invention, there is provided packaging comprising:

an outer packet part;

a plurality of inner packet parts, wherein each of the inner packet parts is movable relative to the outer packet part between a closed position and an open position;

a seal comprising a body portion coupled to the outer packet part and a plurality of tamper evidencing portions extending from the body portion, each of the inner packet parts being coupled to at least one tamper evidencing portion such that movement of an inner packet part from the closed position to the open position causes irreversible alteration of the seal between the body portion and a tamper evidencing portion to indicate that the inner packet part was opened.

The present invention can allow a seal to be provided which is irreversibly altered in its physical or optical structure (i.e. broken, deformed, discoloured, hazed or any change of optical properties) if any of the inner packet parts moves relative to the outer packet part. This is because each of the inner packet parts is coupled to a tamper evidencing portion, eventually a separable portion, of the seal, while an adjacent body portion of the seal is coupled to the outer packet part. As such, movement of the inner packet part relative to the outer packet part causes the tamper evidencing portion to move relative to the body portion, thus irreversibly altering the seal.

In an embodiment, the seal of the packaging of the invention is a frangible seal and movement of an inner packet part from the closed position to the open position causes the seal to break.

In preferred embodiments, each tamper evidencing portion is separated from the body portion by a tear line. A tear line is a linear portion of the seal that is weakened relative to the basic material of the seal. For example, a tear line may comprise a linear array of perforations in the seal. The tear line provides a weakened portion of the seal which can more easily be broken when an inner packet part is moved from the closed position to the open position. Additionally, or alternatively, each tamper evidencing portion may be separated from the body portion by a fold line. A fold line is a linear region of the seal that has been pre-folded. This also assists in the breaking of the seal. In preferred embodiments, the fold lines and tear lines are co-located. This provides a single line that is easily broken as an inner packet part is opened.

Coupling of the body portion and the tamper evidencing portions of the seal to the inner and outer packet parts may be direct (i.e. there may be direct contact between these features) or may be indirect.

In a preferred embodiment, the packaging comprises exactly two inner packet parts. The provision of two inner packet parts is found to offer a user-friendly arrangement that provides ergonomic feel. Multiple inner packet parts provide freshness for products within unopened inner packet parts, while limiting the number of inner packet parts avoids unnecessary complexity.

Preferably, each tamper evidencing portion extends orthogonally to an adjacent region of the body portion. This assists in the process of breaking the seal by reducing the component of the breaking force that acts against the coupling of the body and tamper evidencing portions to the inner and outer packet parts. Thus, the coupling of the tamper evidencing portions and the body portions is more secure, increasing the reliability of the seal.

In particularly preferred embodiments, at least part of the body portion is provided on a side face of the outer packet part, preferably a major side face, such as the front face or rear face. Furthermore, the tamper evidencing portions are preferably provided on an end face of the packaging, such as the top or bottom of the packaging. In a particular embodiment, at least part of the body portion is provided in the front face of the packaging and/or the tamper evidencing portions are provided on a bottom face of the packaging.

Preferably, movement of each inner packet part from the closed position to the open position comprises rotational movement relative to the outer packet part. The movement of the inner packet part may additionally comprise a linear element, but most preferably consists solely of rotational movement. Rotational movement of the inner packet part around an axis provides a positive user experience, and can assist in the breaking of the seal by applying a stress force to break the seal rather than a shear force that may be present in translational movement of the inner packet part.

In preferred embodiments, the tamper evidencing portions are coupled to the inner packet parts proximal to an axis around which the inner packet parts rotate from the closed position to the open position. By locating the tamper evidencing portions adjacent to or near the rotational axis of the inner packet parts, a levering effect can be employed to increase the breaking force applied to the seal as the inner packet part is opened. That is, moving the inner packet part through a relatively large distance at a point away from the rotational axis by applying a relatively small force can create a larger force at the point of the seal through a smaller distance.

To take advantage of this effect, in preferred embodiments the outer packet part comprises one or more openings to enable use access to the inner packet parts when in the closed position, wherein the openings are located at a greater distance from the axis around which the inner packet part rotates than the tamper evidencing portion coupled to that inner packet part.

The packaging is preferably packaging for tobacco products, and more preferably packaging for cigarettes. The frangible seal is preferably a tax stamp.

According to a second aspect of the present invention, there is provided a blank for forming an inner packet part according to the first aspect According to a third aspect, there is provided blank for forming the outer packet part of the first aspect.

In a fourth aspect of the present invention, there is provided a method for producing packaging, wherein the method comprises, folding a blank to form an outer packet part, folding a plurality of blanks to form a plurality of inner packet parts, coupling the inner packet parts to the outer packet part such that the inner packet parts are disposed within the outer packet part and are movable relative to the outer packet part between a closed position and an open position, providing a frangible seal comprising a body portion coupled to the outer packet part and a plurality of tamper evidencing portions extending from the body portion, each of the inner packet parts being coupled to at least one tamper evidencing portion such that movement of an inner packet part from the closed position to the open position causes the seal to break.

DETAILED DESCRIPTION

Figure 1A:
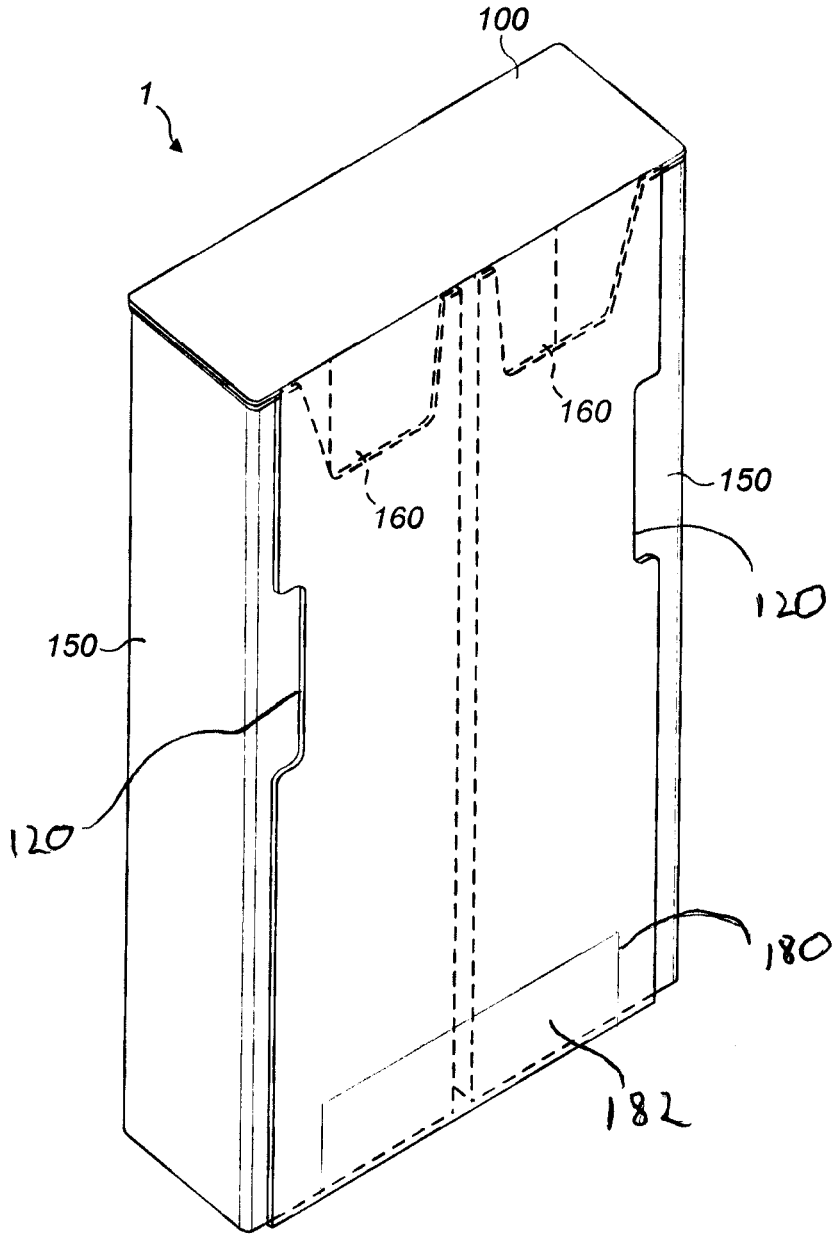
FIG. 1A shows packaging according to a preferred embodiment in which inner packet parts are disposed in a closed position within an outer packet part.
Figure 1B:
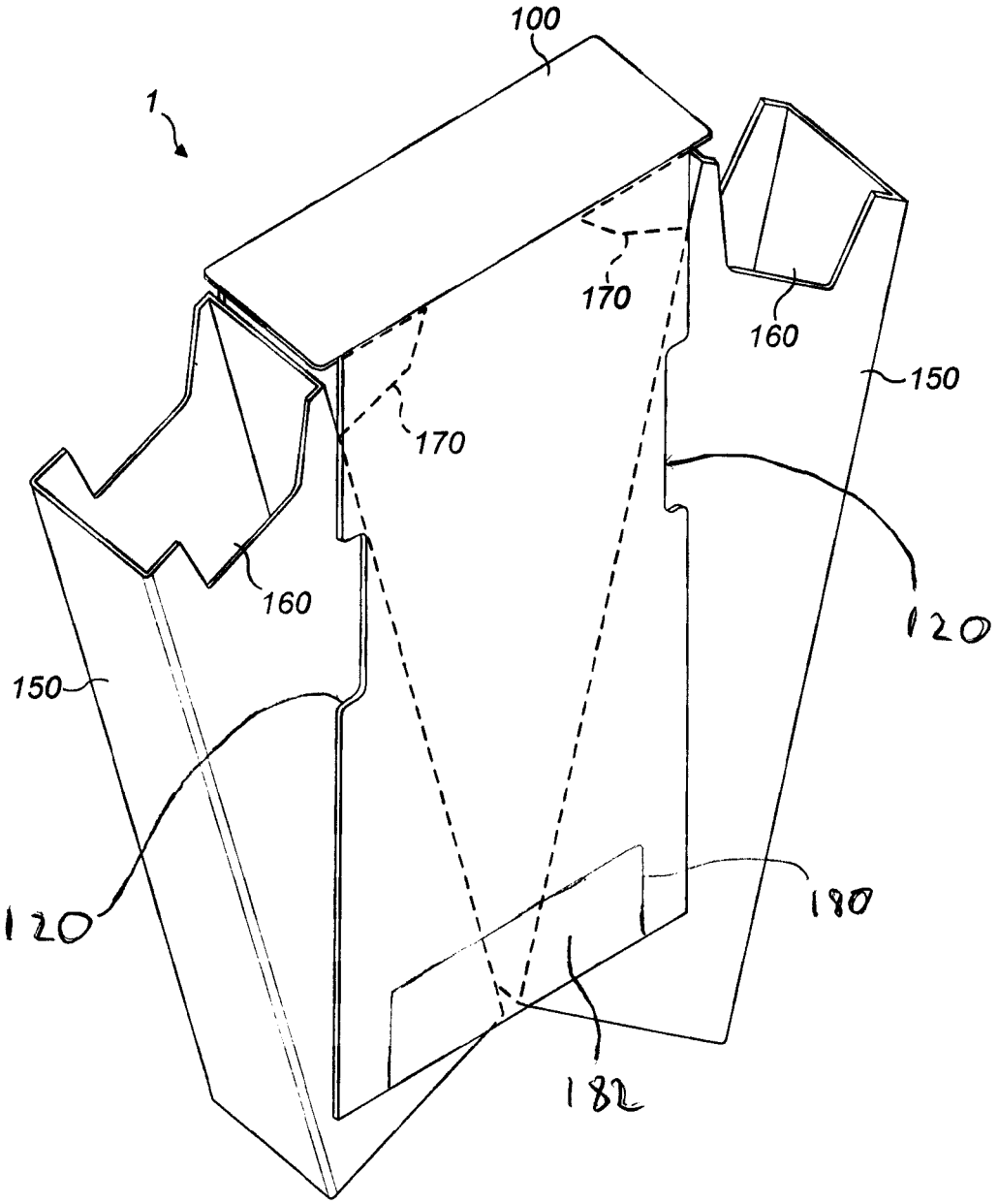
FIG. 1B shows the preferred embodiment when the inner packet parts are in an open position.

Packaging 1 according to a preferred embodiment of the present invention is illustrated in FIGS. 1A and 1B. The packaging 1 comprises an outer packet part 100 and two inner packet parts 150. Each inner packet part 150 is independently movable relative to the outer packet part 100 between a closed position and an open position.

The packaging 1 of the preferred embodiment is used to store tobacco products. In particular, the packaging 1 is preferably packaging for cigarettes. Although not shown in FIGS. 1A and 1B, the cigarettes are disposed longitudinally within the packaging, allowing a user to retrieve them from an inner packet part 150 when it is in an open position.

In FIG. 1A, the inner packet parts 150 are shown in their closed positions, while in FIG. 1B the inner packet parts 150 are in their open positions. The inner packet part 150 comprises an opening 160 which allows user access to the products within the packaging, which in preferred examples may be cigarettes. In the closed position shown in FIG. 1A, it can be seen that the opening 160 is concealed by the outer packet part 100. As such, the user is unable to access the products when the inner packet parts 150 are in the closed position. In contrast, when the inner packet parts 150 are rotated to the open position, as shown in FIG. 1B, the opening 160 is accessible to the user, allowing access to the product. It will be appreciated that although both inner packet parts 150 have been rotated to the open position in FIG. 1B, they are operated independently of one another. As such, the inner packet parts 150 may be in different positions at a given time.

The packaging further comprises a frangible seal 180. In FIGS. 1A and 1B, a body portion 182 of the frangible seal 180 can be seen coupled directly to the front face of the outer packet part 100.

Figure 3A:
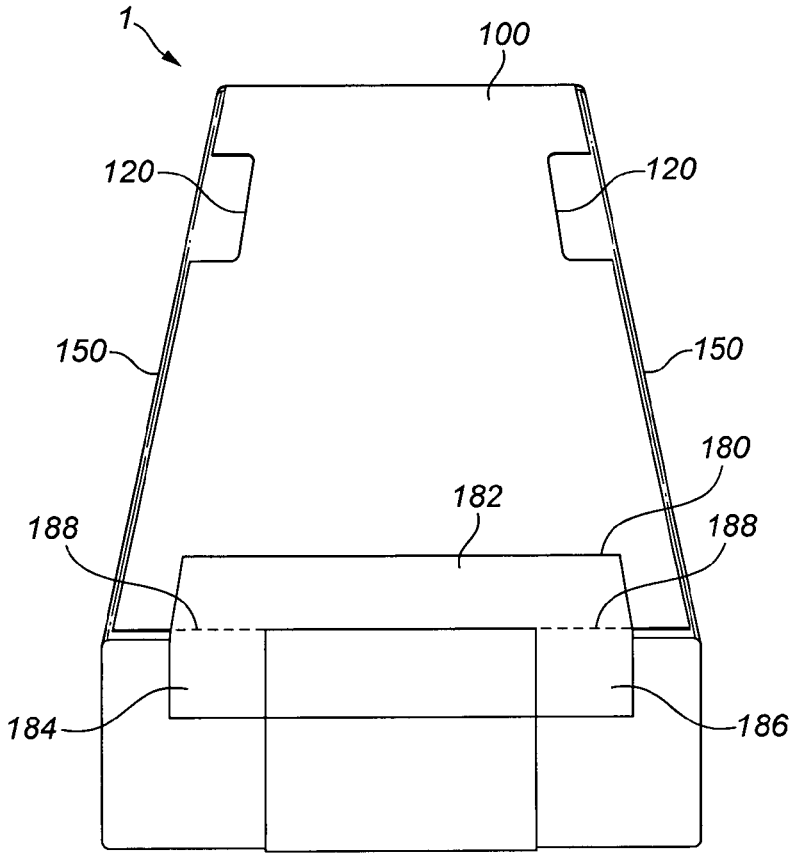
FIG. 3A illustrates the position of a frangible seal on the packaging of the preferred embodiment when both inner packet parts are closed.
Figure 3B:
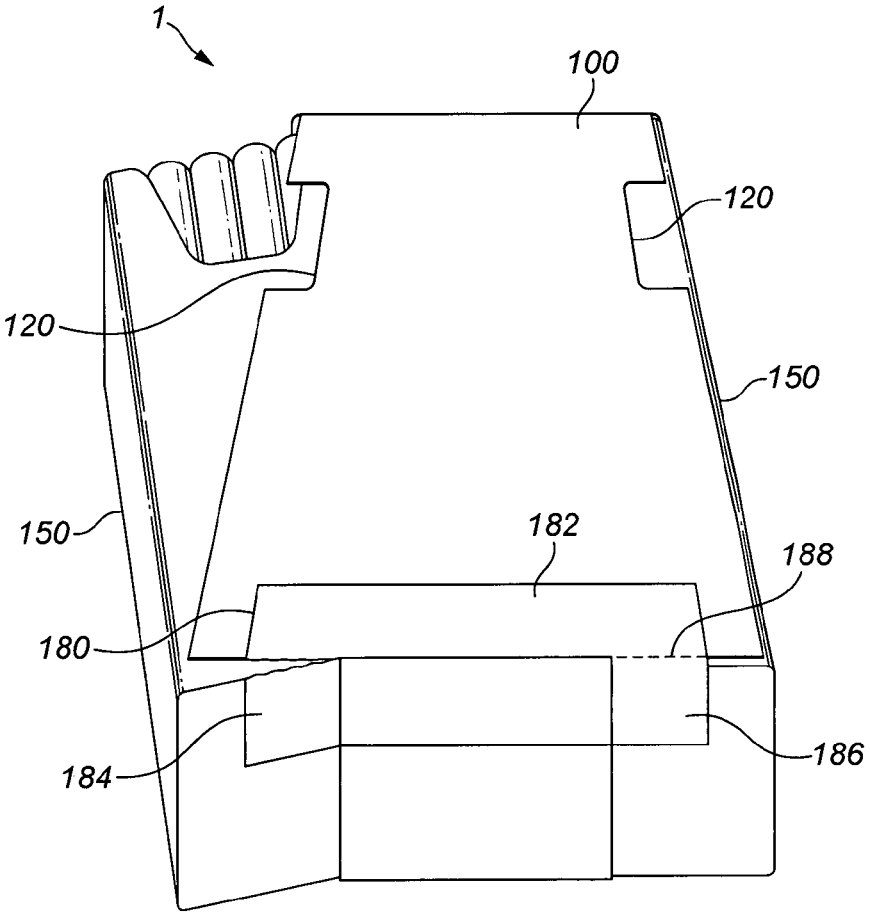
FIG. 3B illustrates the position of a frangible seal on the packaging of the preferred embodiment when one of the inner packet parts is in an open position.

The frangible seal 180 can be further understood with reference to FIGS. 3A and 3B. In FIG. 3A, both inner packet parts 150 are illustrated in the closed position, while in FIG. 3B a first of the inner packet parts 150 is in an open position. As can be seen in FIGS. 3A and 3B, the frangible seal further comprises a first tamper evidencing portion 184 coupled to the first of the inner packet parts 150 and a second tamper evidencing portion 186 coupled to a second of the inner packet parts 150. FIGS. 3A and 3B further show that the body portion 182 of the inner packet part extends from the front face of the packaging 1 around to the bottom face of the packaging 1.

Accordingly a region of the body portion 182 (the region on the front face of the packaging 1) is provided orthogonally to the tamper evidencing portions 184, 186 (which are provided on the bottom face of the packaging 1). The junctions between that region of the body portion 182 and the tamper evidencing portions 184, 186 are defined by tear lines 188. The tear lines 188 are weakened portions of the seal 180. In particular, weakening of the seal is provided by a linear array of perforations at the tear lines 188.

As the tear lines 188 are located at the junction of the front face and the bottom face of the packaging 1, they are also fold lines. That is to say, the tear lines 188 are pre-folded as the packaging 1 is formed. This further weakens the tear lines 188, assisting in the breaking of the seal 180 as the inner packet parts 150 move from the closed position to the open position at first time the user opens it.

As will be described in greater detail below, the inner packet parts 150 move rotationally from the closed position to the open position. As such, the inner packet parts 150 move around axes of rotation. The tamper evidencing portions 184, 186 extend from the axes of rotation and are thus located adjacent to them. Accordingly, a levering effect can be employed to increase the force applied to separate the tamper evidencing portions 184, 186 from the body position 182 if an actuating force is applied at a point further from the axis of rotation than the tamper evidencing portions 184, 186.

To take advantage of this effect, actuating openings 120 can be provided in the outer packet part 100. These allow user access to the inner packet parts 150 when in the closed position. The actuating openings 120 may take the form of cutaway portions of the front face and rear face of the outer packet part 100 and allow the user to grip an inner packet part 150 to rotate it away from the closed position to the open position. The actuating openings 120 are located at a position further from the axis of rotation of the inner packet parts 150 than the tamper evidencing portions 184, 186. As such, when the user grips an inner packet part 150 through the access provided by the actuating openings 120 they are able to employ a levering effect to increase the force used to separate the tamper evidencing portion 184, 186 coupled to that inner packet part 150 from the region of the body portion 180 coupled to the front face of the packaging 1.

Alternatively, the actuating opening may be replaced by small tabs extending on top of the inner packet parts 150 side walls such that it proffers over the top panel of the outer packet part 100 in the closed position.

The inner packet parts 150 further comprise a linking element 170 which is fixed to a top face of the outer packet part 100. The top face of the outer packet part 100 thus acts as a connecting face for the linking element 170. The linking element 170 prevents movement of the inner packet parts 150 beyond the open position. The inner packet parts 150 are also coupled to the outer packet part 100 at its base, and in particular are mounted on a hinged flap of the outer packet part 100. The hinged flap is arranged to rotate around a position disposed inwardly from the side faces of the packaging 1. As such, as the inner packet parts 150 rotate outwardly towards the open position, the outer side faces and bottom corners of the inner packet parts 150 move downwardly relative to the outer packet part 100 and below the level of the bottom face of the outer packet part 100. The configuration allows the overall size, and particularly the height, of the packaging 1 to be the same as a conventional cigarette pack, often known as a crush-proof box.

The linking element 170 is flexible. As such, its shape can be altered during movement of the inner packet part 150 between the open position and the closed position. In this embodiment, this allows the linking element 170 to be folded around the inner packet part 150 when the inner packet part 150 is in the closed position, and as such does not require additional space to be provided in the outer packet part 100.

Figure 2A:
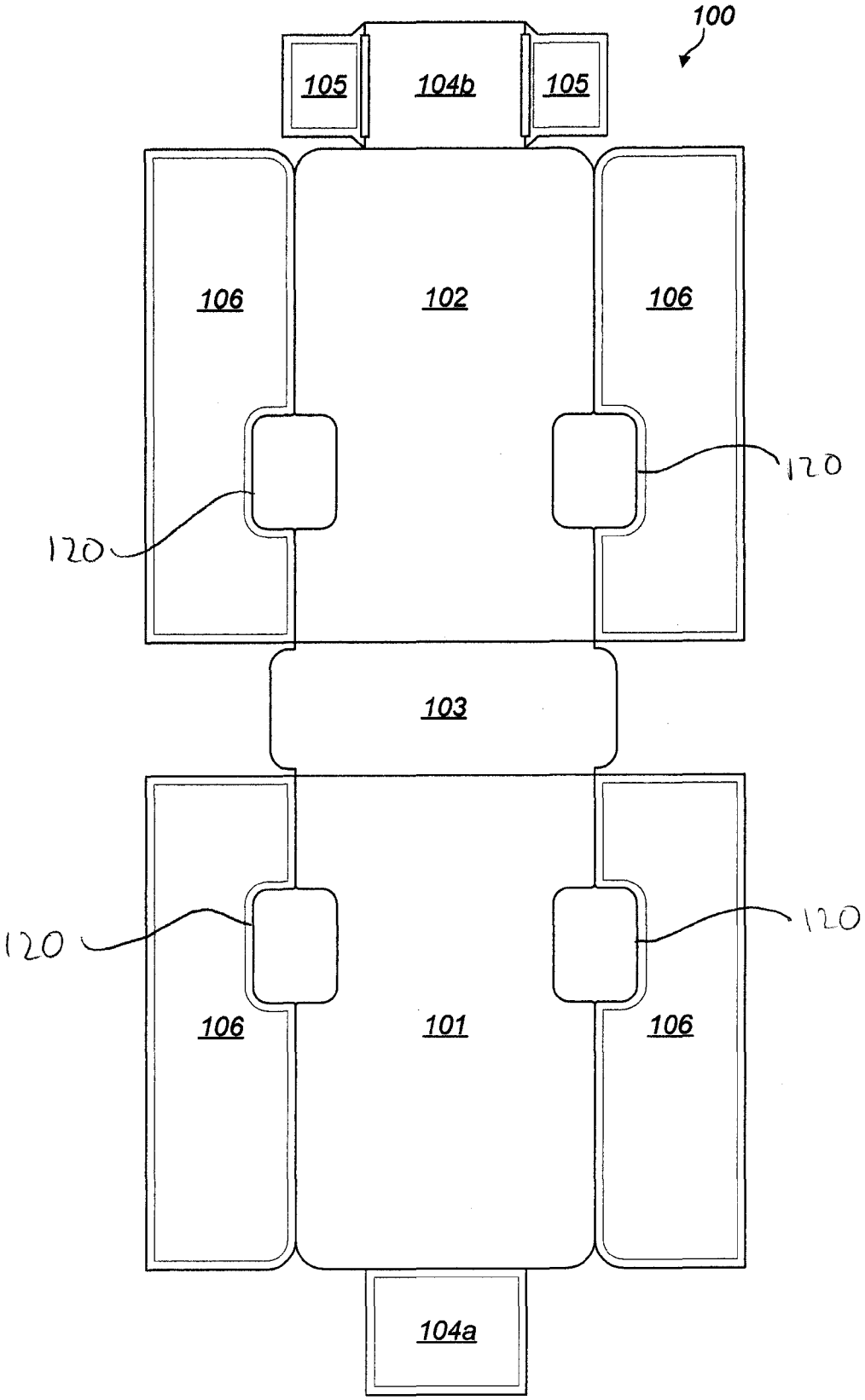
FIG. 2A shows a blank from outer packet part of the preferred embodiment may be formed.
Figure 2B:
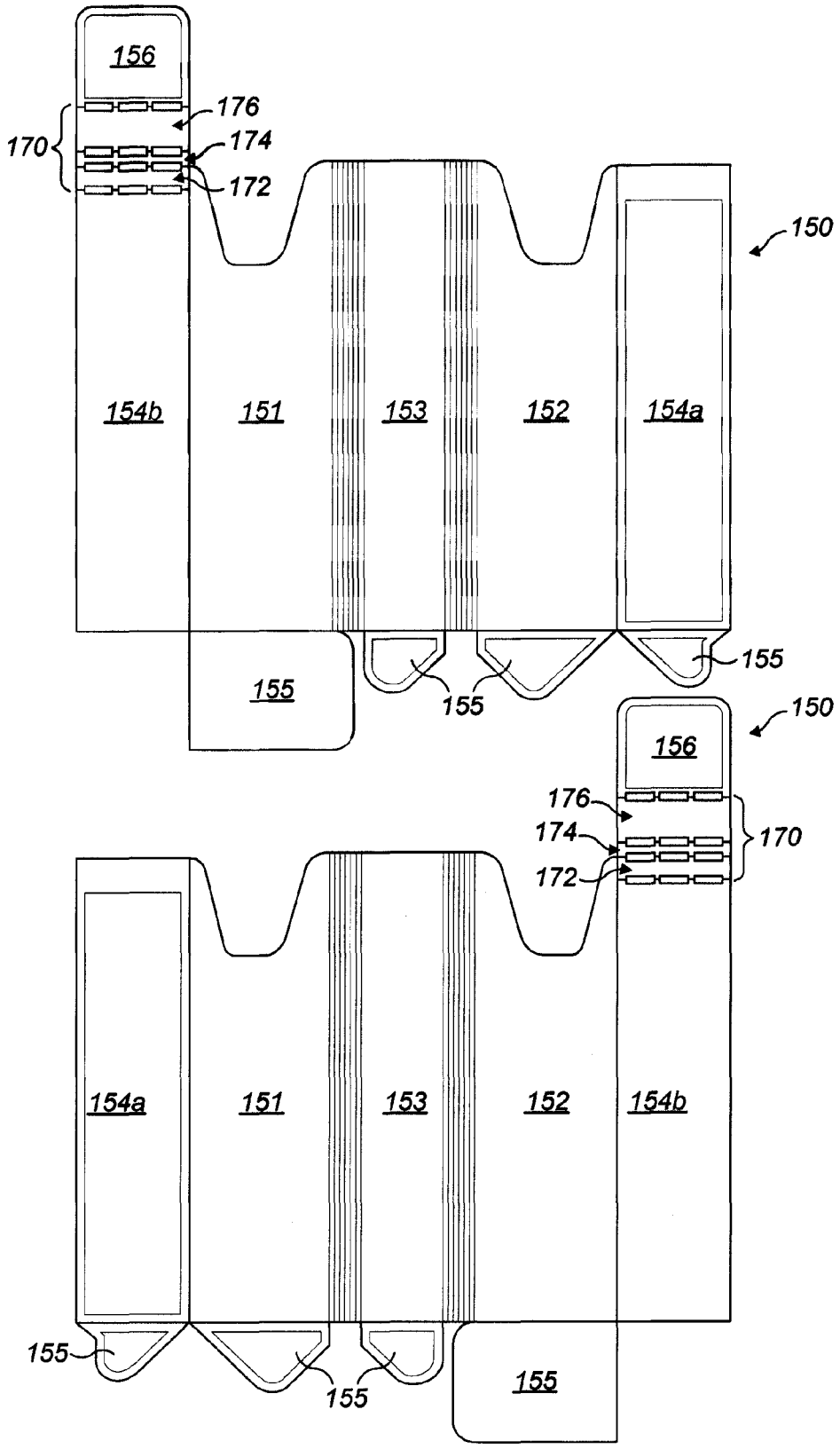
FIG. 2B shows blanks from which the inner packet parts of the preferred embodiment may be formed.

The construction of the inner and outer packet parts may be further understood with reference to FIGS. 2A and 2B, which illustrate blanks for the production of the outer packet part 100 and the inner packet parts 150 respectively.

Referring to FIG. 2A, the outer packet part 100 comprises a front face 101 and a rear face 102. A top face 103 is provided between the front face 101 and the rear face 102. The bottom face 104 comprises a first bottom face part 104*a* formed integrally with the front face 101 and a second bottom face part 104*b* formed integrally with the rear face 102. Hinged flaps 105 are provided connected to the second bottom face part 104*b*. The outer packet part 100 further comprises reinforcing tabs 106 extending from the side edges of the front face 101 and the rear face 102.

When formed, the outer packet part 100 is folded such that the front face 101 and the rear face 102 oppose each other. The top face 103 extends between and perpendicular to the front face 101 and the rear face 102. The bottom face 104, which also extends between and perpendicular to the front face 101 and the rear face 102, is formed by gluing the first bottom face part 104*a* to a lower surface of the second bottom face part 104*b*. The hinged flaps 105 are left free to rotate relative to the bottom face 104. The bottom face 104 does not extend the entire width of the outer packet part 100. As a result, the hinged flaps 105 rotate around an axis inset from the openings in the sides of the outer packet part 100. In the preferred embodiment, each axis is inset by approximately a quarter of the width of the outer packet part 100 (and thus half the width of the inner packet parts 150). The inner packet 150 part is then glued to the hinged flaps 105. The reinforcing tabs 106 are folded inwardly and glued to inner surfaces of the front face 101 and the rear face 102.

FIG. 2B illustrates blanks for forming the inner packet parts 150. Each inner packet part comprises a front face 151 and a rear face 152. There is further provided an outer side face 153 between the front face 151 and the rear face 152. An inner side face 154 is formed of first inner side face part 154*a* and second inner side face part 154*b*. A bottom face of the inner packet part 150 is formed from bottom face tabs 155.

The linking element 170 extends from the second inner face part 154*b*. The linking element 170 comprises the substantially planar connecting sections, referred to hereinafter as a first connecting section 172, a second connecting section 174, and a third connecting section 176. Fold lines between connecting sections 172, 174, 176 allow relative rotation of each section as the inner packet part 150 is rotated between the closed position and the open position. In this manner, the linking element 170 is flexible, and in particular in the preferred embodiment is precisely articulated between each of the connecting sections 172, 174, 176, even though the connecting sections are themselves substantially rigid. A mounting tab 156 is formed at the end of the third connecting section 176. The articulated structure of the linking element 170 not only provides flexibility to the linking element 170 but also guides the course of the inner packet part 150 during opening and closing motions relative to the outer packet part 100 without increasing the overall size (height and width particularly) of the packaging 1 compared to a regular crush-proof cigarette pack.

When the inner packet parts 150 are formed, the blanks are folded such that the front face 151 and the rear face 152 oppose each other. The outer side face 153 extends between the front face 151 and the rear face 152, while the inner side face 154 also extends between the front face 151 and rear face 152 and is formed by gluing first inner side face part 154*a* to second inner side face part 154*b*. A bottom face is formed by gluing bottom face tabs 155 to each other. The bottom face is itself glued to a hinged flap 105 of the outer packet part 100.

The linking element 170 extends from the top edge of the inner side face 154. The linking element 170 extends from a position below the top edge of the front and rear faces 151, 152 by setting the length of the first connecting section 172 to approximately the distance between the top edge of the inner side face 154 and that of the front and rear faces 151, 152.

The mounting tab 156 is glued to an inner surface of the top face 103 of the outer packet part 100, and in particular is connected towards an outer edge of the top face 103. Accordingly, when the inner packet part 100 is in the closed position, as illustrated in FIG. 1A, the linking element 170 extends inwardly from its connection to the top face via the mounting tab 156 across an upper end of the inner packet part 150.

During manufacture, after the inner packet parts 150 are disposed within the outer packet part 100, they are placed in the closed position. The frangible seal is then applied to the packaging 1, as shown in FIG. 3A.

A user may operate the packaging by holding an inner packet 150 through the actuating openings 120 that provide access to that inner packet part 150. The user then moves the inner packet part 150 to the open position. FIG. 3B shows, for example, the position when a first inner packet part 184 has been moved to the open position. As can be understood from FIG. 3B, this movement causes the frangible seal 180 to break along a tear line 188. This provides a clear indication that the packaging 1 has been opened. Accordingly, the seal 180 can act as a tamper evident seal, preventing, for example, re-filling and re-sale of the same packaging on multiple occasions. This therefore allows the seal 180 to act as a tax, or revenue, stamp, showing that appropriate duty has been paid for the products within the packaging 1.

The above description refers to a particularly preferred embodiment. However, the skilled person will recognise that variations and modifications can be applied as appropriate. For example, while the above embodiment provides two inner packet parts 150, other embodiments may comprise a different number of inner packet parts.

Similarly, while the packaging of the above-described embodiment is designed for tobacco products, and particularly for cigarettes, other products may be provided within the inner packet part. Furthermore, the skilled person may modify or alter the particular geometry and arrangement of the particular features of the packaging.

Other variations and modifications will also be apparent to the skilled person. Such variations and modifications may involve equivalent and other features which are already known and which may be used instead of, or in addition to, features described herein. Features that are described in the context of separate embodiments may be provided in combination in a single embodiment. Conversely, features which are described in the context of a single embodiment may also be provided separately or in any suitable sub-combination.

The invention claimed is:

1. Packaging, comprising:

an outer packet part;

a plurality of inner packet parts, wherein each of said plurality of inner packet parts is movable relative to the outer packet part between a closed position and an open position;

a seal comprising a body portion coupled to the outer packet part, and a plurality of tamper evidencing portions extending from the body portion, wherein each of said plurality of inner packet parts being coupled to at least one of said plurality of tamper evidencing portions such that a movement of each of said plurality of inner packet parts from the closed position to the open position causes an irreversible alteration of the seal at a position between the body portion of said seal and a tamper evidencing portion of said plurality of tamper evidencing portions to indicate that at least one of said plurality of inner packet parts was opened.

2. The packaging according to claim 1, wherein the seal is a frangible seal, and wherein the movement of each of said plurality of an inner packet parts from the closed position to the open position causes the seal to break.

3. The packaging according to claim 1, wherein each of said plurality of tamper evidencing portions is separated from an adjacent region of the body portion by either one of a tear line or a fold line.

4. The packaging according to claim 1, comprising two inner packet parts.

5. The packaging according to claim 1, wherein each of said plurality of tamper evidencing portions extends orthogonally to an adjacent region of the body portion.

6. The packaging according to claim 1, wherein at least a part of the body portion is provided on a side face of the outer packet part.

7. The packaging according to claim 1, wherein the plurality of tamper evidencing portions are provided on an end face of the packaging.

8. The packaging according to claim 1, wherein said movement of each of said plurality of inner packet parts from the closed position to the open position comprises a rotational movement of said plurality of inner packet parts relative to the outer packet part.

9. The packaging according to claim 1, wherein the plurality of tamper evidencing portions are coupled to the plurality of inner packet parts proximal to an axis, said plurality of inner packet parts capable of rotating around said axis from the closed position to the open position.

10. The packaging according to claim 9, wherein the outer packet part comprises one or more openings enabling user access to the plurality of inner packet parts when in a closed position, and wherein said one or more openings are located at a distance from the axis that is greater than a distance over which the plurality of the tamper evidencing portions are coupled to said plurality of inner packet parts.

11. The packaging according to claim 1, wherein the packaging comprises tobacco products.

12. The packaging according to claim 1, wherein the seal comprises a tax stamp.

13. A blank for forming the plurality of inner packet parts of claim 1.

14. A blank for forming the outer packet part of claim 1.

15. A method for producing packaging, comprising:

folding a blank to form an outer packet part;

folding a plurality of blanks to form a plurality of inner packet parts;

coupling the plurality of inner packet parts to the outer packet part such that said plurality of inner packet parts are disposed within the outer packet part and are movable relative to the outer packet part between a closed position and an open position; and providing a seal comprising a body portion coupled to the outer packet part, and providing a plurality of tamper evidencing portions extending from the body portion, each of the plurality of inner packet parts being coupled to at least one of said plurality of tamper evidencing portions such that a movement of each of said plurality of inner packet parts from the closed position to the open position causes an irreversible alteration of the seal at a portion between the body portion of said seal and a tamper evidencing portion of said plurality of tamper evidencing portions to indicate that at least one of said plurality of inner packet parts was opened.

* * * * *